United States Patent [19]

Salloum

[11] Patent Number: 4,896,612

[45] Date of Patent: Jan. 30, 1990

[54] MOLDED PLASTIC PALLET SYSTEM

[75] Inventor: James S. Salloum, Oxford, Mich.

[73] Assignee: Creative Techniques, Inc., Aurburn Hills, Mich.

[21] Appl. No.: 247,404

[22] Filed: Sep. 21, 1988

Related U.S. Application Data

[63] Continuation of Ser. No. 63,028, Jun. 17, 1987, abandoned.

[51] Int. Cl.[4] ..... B65D 19/18

[52] U.S. Cl. ..... 108/55.3; 108/901; 269/900

[58] Field of Search ..... 108/51.1, 55.3, 56.3, 108/901, 902; 248/346; 206/386; 269/900

[56] References Cited

U.S. PATENT DOCUMENTS

| | | | |
|---|---|---|---|
| 2,621,807 | 12/1952 | Rendich | 269/900 |
| 3,315,800 | 4/1967 | Wagner | 108/55.3 X |
| 3,493,201 | 2/1970 | Marran | 248/346 X |
| 3,680,495 | 8/1972 | Pike | 108/53.3 |
| 3,691,965 | 9/1972 | Cloyd | 108/901 X |
| 4,121,817 | 10/1978 | Pavlovsky | 269/900 X |
| 4,183,491 | 1/1980 | Sanders et al. | 108/901 X |
| 4,287,836 | 9/1981 | Aoki | 108/901 X |
| 4,393,999 | 7/1983 | Forshee | 108/55.3 X |
| 4,403,555 | 9/1983 | Forrest | 108/901 X |
| 4,403,697 | 9/1983 | Forshee | 108/55.3 X |
| 4,782,763 | 11/1988 | Salloum | 108/55.3 |

FOREIGN PATENT DOCUMENTS

| | | | |
|---|---|---|---|
| 184028 | 11/1982 | Japan | 108/55.3 |
| 764929 | 9/1980 | U.S.S.R. | 269/900 |
| 1038767 | 8/1966 | United Kingdom | 108/55.3 |

*Primary Examiner*—Peter A. Aschenbrenner
*Attorney, Agent, or Firm*—Harness, Dickey & Pierce

[57] ABSTRACT

A pallet system formed of a unitary, plastic molded, grid-like base made of intersecting, spaced apart, longitudinal and transverse strips, whose upper edges define a carrying surface. The lower edges of at least some of the longitudinal strips are generally coplanar to form a skid-like base support surface that may be positioned upon a conveyor. The lower edges of the remaining strips are recessed relative to the plane of the support surface. A unitary, plastic molded nest, having integral upper formations shaped to receive corresponding portions of supported articles, is rested upon the base and overlaps some of the openings in the grid-like base. Integral projections on the nest extend into their adjacent overlapped openings and engage the sides of adjacent strips for accurately positioning the nest relative to the base. Mechanical fasteners, having stems extending through some of the opening and connected to the nest, have resilient heads that span the adjacent recessed strip edges for releasably securing the nest to the base, so that the nest may be replaced by a differently shaped nest for supporting a different article.

9 Claims, 2 Drawing Sheets

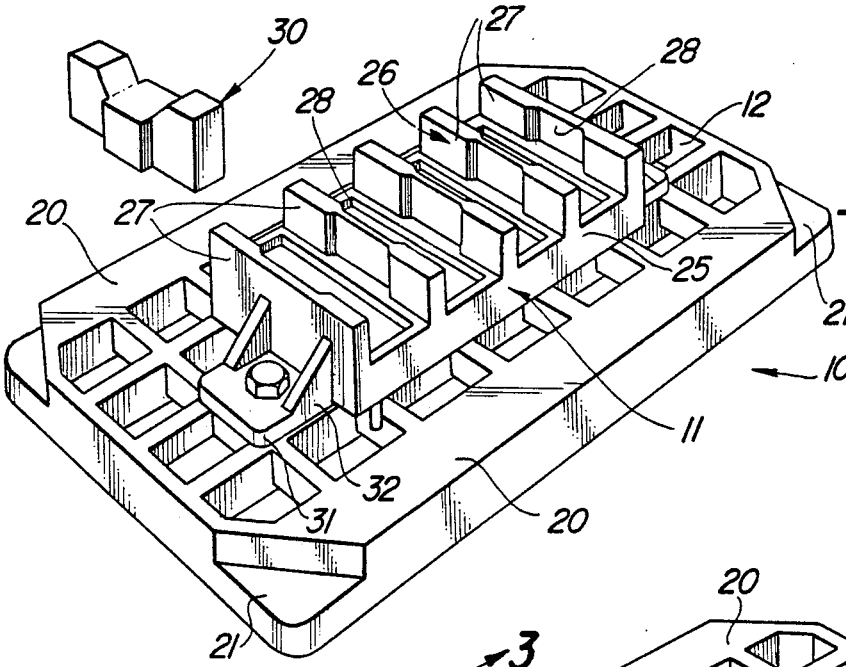
Fig-1
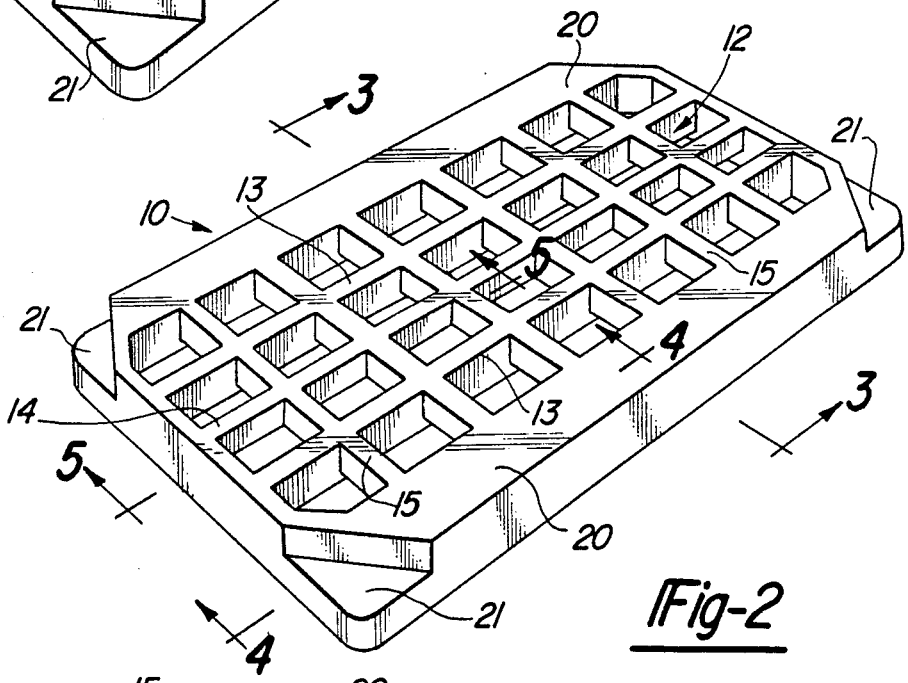
Fig-2
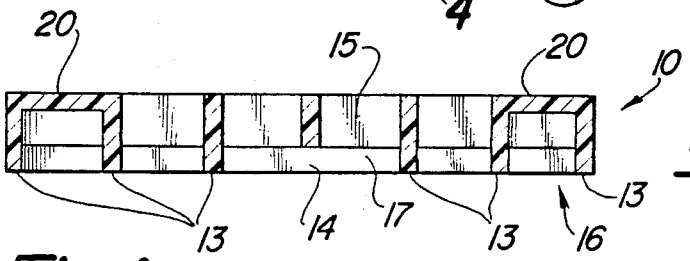
Fig-3
Fig-4
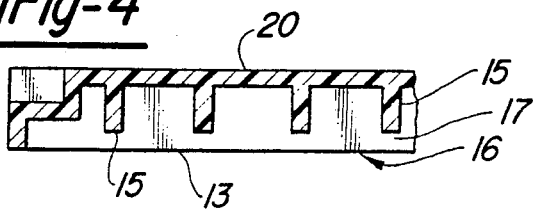
Fig-5
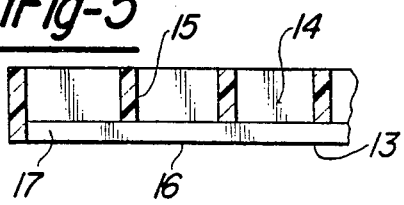

MOLDED PLASTIC PALLET SYSTEM

This is a continuation of application Ser. No. 07/063,028 filed June 17, 1987.

BACKGROUND OF INVENTION

This invention relates to an improved pallet useful for storing or for conveying articles, such as industrial parts. In the manufacture of many different kinds of industrial parts, as for example, automotive parts, it is conventional to place the parts upon pallets for storage or for movement. The transportation of the parts between manufacturing operations or between different use or storage locations is accomplished by moving the parts loaded pallet. Typically, a pallet may be moved upon a truck, railroad car, a fork truck or other mechanized lift-type vehicle, or upon a suitable conveyor.

Conventional pallets generally comprise a platform upon which the parts are positioned. Sometimes, the parts may be rested directly upon the upper surface of the platform. At other times, they may be loaded into containers, such as boxes or baskets which are placed upon the platform. In some instances, nests or cradle-like supports are mounted upon the platforms to receive and hold the parts. The shapes of the nests or cradles correspond to the portions of the parts which fit into them so that the parts can be stabilized upon the pallet surface to avoid damage or prevent movement relative to the pallet.

Usually, pallets are formed either of wood or of metal. Likewise, the typical cradles or nests that are used with pallets, have been formed of wood cut to the required forms or of metal bent, cut, and welded to the required shapes.

The conventional wood and metal materials that are used present problems. That is, the wood used for pallets is relatively expensive and considerable labor is needed to fashion wood into pallets and nests. Further, wood pallets are easily damaged so that re-use of wood pallets is limited. Consequently, wood pallets are relatively expensive. In addition, since wood is flammable, particularly when oil soaked, the use of pallets within factory buildings is undesirable.

Generally, metal pallets are heavy, which increases handling and shipping costs. Also, metal pallets are relatively expensive to make. Since they can be easily damaged in transit, and they frequently corrode, their useful lives are very limited. Moreover, they require painting or an oil covering to inhibit corrosion, which makes them flammable.

Thus, there has been a need for relatively inexpensive, fire-resistant, durable pallets, particularly of the type useful for nesting or cradling articles.

SUMMARY OF INVENTION

This invention contemplates a pallet system including a pallet base or platform and article nests or cradles which are molded out of plastics. The cradles and the base portions upon which they are mounted are formed for easy and rapid connection and disconnection so that nests can be interchanged when desirable for different articles. Moreover, the pallet bases are formed to be relatively light weight, yet extremely strong and durable for their relative sizes and shapes.

More specifically, the invention contemplates a pallet base formed in an open, grid-like shape having intersecting, spaced apart, longitudinal and transverse strips which are integral at their intersections. The upper edges of the strips form the carrying surface of the pallet base. The lower edges of a considerable number of the longitudinal strips form a rail-like or skid-like palet support surface which may be rested upon a conveyor, or vehicle floor or the ground or the like. However, the bottom edges of the remaining strips are recessed upwardly, relative to the support surface plane. Releasable fasteners extend through the grid openings and have heads located within the recesses provided by the recessed strip edges. The fasteners extend upwardly for attachment to molded plastic nests or cradles.

The molded plastic nests or cradles may be formed as single article support units or as multiple support units, depending upon the sizes and shapes of the articles to be supported. Essentially, these nests comprise a body having an uppper formation or shape which corresponds to, and receives, the portion of the article to be fitted into the formation. The bottoms of the nests are formed to rest upon the support surface of the pallet. The nests include fastening portions which overlie some of the grid openings and to which the fasteners are connected.

Preferably, the fastener heads are resilient in order to tightly secure the nests to the pallet base while absorbing some of the shock forces encountered during movement of the pallets. The heads are shaped to span and to engage against a pair of adjacent recessed strip edges and to resiliently bend under load.

The invention contemplates a means for rapidly and accurately positioning different size and shape nests upon the pallet base. Thus, nests of one shape may be removed and replaced with nests of another shape when desired. The positioning means comprises downwardly extended pegs or nibs or projections that are molded integrally with the nests and are located to extend into the grid openings. The pegs are located to engage the adjacent surfaces of the nearest longitudinal or transverse strip. Consequently, manually pressing a nest downwardly against the pallet base causes its pegs to guide, frictionally engage and accurately position the nest relative to a predetermined location on the pallet base.

A major object of this invention is to provide an improved pallet system which can be produced relatively inexpensively out of plastic injection moldings, which are inexpensive to assemble, which may support different shaped articles, and which are durable and substantially fire-resistant.

Another object of this invention is to provide a relatively light weight, sturdy pallet system which may be transported upon conveyors or moving vehicles and which resist pallet and part damage caused by shock forces encountered in the transportation movements.

A further object of this invention is to provide a pallet system which is basically open, smooth surfaced and of clean-line construction so that the pallet system resists collecting dirt and debris and the like, and which may be very easily cleaned. Thus, the pallet can be reused repeatedly.

These and other objects and advantages of this invention will become apparent upon reading the following description, of which the attached drawings form a part.

DESCRIPTION OF DRAWINGS

FIG. 1 is a perspective view of the pallet system, including showing an article to be carried.

FIG. 2 is a perspective view of the pallet base.

FIG. 3 is a cross-sectional view of the pallet base taken in the direction of arrows 3—3 of FIG. 2.

FIG. 4 is a fragmentary, cross-sectional view of the pallet base taken in the direction of arrows 4—4 of FIG. 2.

FIG. 5 is a fragmentary, cross-sectional view of the pallet base taken in the direction of arrows 5—5 of FIG. 2.

DETAILED DESCRIPTION

Figure 6:
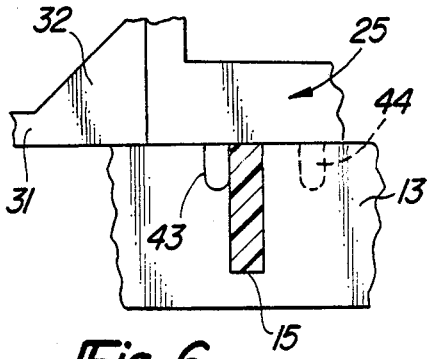
FIG. 6 is an enlarged, fragmentary view showing the abutment between a locating peg and a pallet base grid strip.
Figure 7:
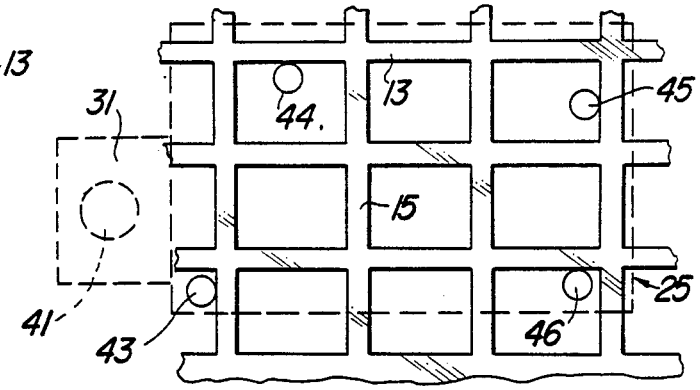
FIG. 7 is a schematic, fragmentary, plan view of the pallet base grid, upon which a nest is located, as shown in dotted lines, with peg projections engaged within the grid.
Figure 8:
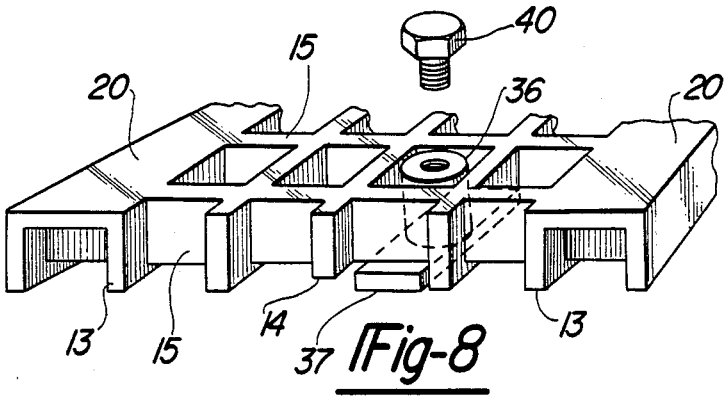
FIG. 8 is a fragmentary, perspective view of a portion of the pallet base showing the location of the keeper or fastener.

As shown in FIG. 1, the pallet system comprises a pallet base 10 upon which is mounted a nest or cradle 11. The pallet is formed of an integrally molded, plastic, open grid 12 made up of a number of longitudinal strips 13 and 14 and transverse strips 15.

The grid forming strips are vertically elongated rectangles, in cross-section. The lower edges of the longitudinal strips 13 define a pallet base support plane 16 made up of runners or skids upon which the pallet may be moved or supported. One or more of the longitudinal strips, e.g., strip 14, and the transverse strips 15 may be shorter in height than the longitudinal strips 13 (see FIGS. 3–5). Because of the shorter strips, a space or recess 17 is formed between the plane of the bottoms of the shorter strips and the bottom support plane 16.

The longitudinal sides of the pallet base is formed with integral, upper side edge cover strips 20. These form an upper support along the edges of the pallet and, in addition, overlie any conveyor chain or other conveyor mechanism which may be located at the sides of the pallet. That is, where this pallet is used with chain conveyors, the integral side edge cover strips may overlie the chains. The lower edges of the longitudinal strips 13, acting like runners or skids, may rest upon the usual conveyor cross bars that extend between the conveyor chains. By so covering the conveyor chains, any upward splashing of debris or oil from or downward dropping upon the chains or chain sprockets upon which the chains are mounted and driven is reduced.

The corners of the pallet base are formed with depressions 21. This enables grasping or locating the edges of the pallet when carried upon a conveyor or fastening the pallet upon a transport floor, or the like. That is, the depressions form predetermined places on the pallet for locating or fastening devices.

The pallet nest or cradle 11 (see FIG. 1) is formed with a suitable base 25 and an open, slot-like cavity or cradle formation 26 defined by shaped walls or flanges 27. These walls or flanges are formed with suitable indentations 28 for snugly receiving parts to be carried by the pallet. An example of one form of such parts 30 is schematically illustrated in FIG. 1. Significantly, the shape of the cradle base 25 and its cavity or formation 26, as well as its walls or flanges 27 are dictated by the number and shape and size of the parts to be carried by the pallet. Thus, the particular nest or cradle illustrated is exemplary, with the actual design varied to accommodate the praticular part involved. As can be seen, the nest or cradle may be formed to carry a multiplicity of parts at one time, or, may be formed to carry only one part, depending upon the size, weight, shape, etc.

The nest or cradle, like the pallet base, is molded of a suitable plastic material which is durable, relatively light weight, and particularly, has sufficient strength and rigidity for the intended purpose. There are a number of commercially available plastics suitable or this purpose and therefore, the selection of the particular plastic, which typically is injected molded into the required shapes, may be made by those skilled in the art depending upon availability, expense, and the particular purpose for the specific pallet and base configurations.

The nests include integral lugs or ear extensions 31 for fastening them upon the pallet base. Where necessary, reinforcing side flanges 32 (see FIG. 1) are integrally formed to connect the lugs to the base or body portions 25 of the nest.

The lugs are shaped to overlie at least one opening through the grid of the pallet. Thus, a fastener is used to secure the lug to the grid. The drawings illustrate a preferred fastener 35 which is molded out of a rubber-like or somewhat resilient plastic material shaped as a stem 36 with an integral resiliently bendable head 37. A metal bushing 38 is molded within the head. This bushing has a threaded central opening which receives the threaded shank of a bolt 40 which passes through a hole 41 in the lug 31.

Figure 9:
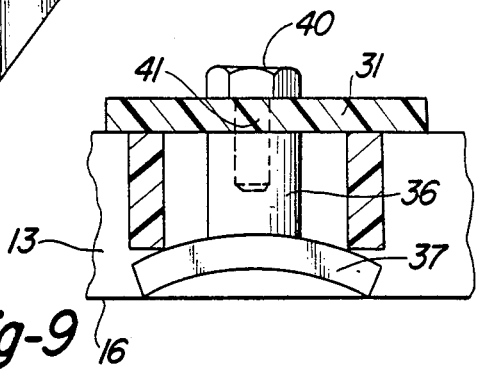
FIG. 9 is an enlarged, fragmentary cross-sectional view showing a keeper or fastener locked in position with its head bowed.
Figure 10:
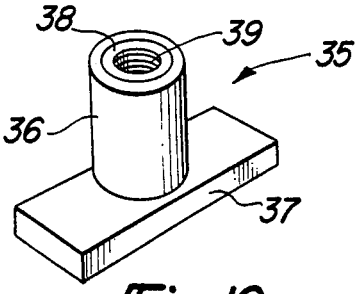
FIG. 10 illustrates, in perspective, a keeper or fastener.
Figure 11:
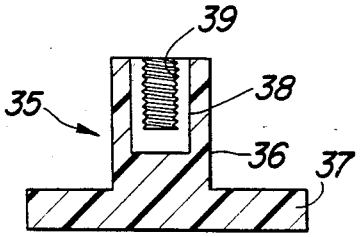
FIG. 11 shows a cross-sectional view of the keeper or fastener.

In use, the fastener head 39 is arranged within the recess 37 which is beneath the lower edges of the strips that the nest lug overlies. The bolt 40 is positioned through the hole 41 in the lug 31 and is threadedly engaged into the threaded opening 38 in the bushing 37 of the fastener stem 36. Preferably, the bolt is sufficiently tightened to resiliently bend or bow the bendable head 37 as illustrated in exaggerated form in FIG. 9. The bent head acts like a leaf spring to both securely fasten the parts together, as well as to absorb some shock loads.

In order to accurately locate the nest upon the pallet base, before applying the fasteners 35, locator pegs or nibs or downward projections 43, 44, 45 and 46 are used. These pegs are integrally molded with the bottoms of the nest bases or bodies 25. The pegs are arranged so that each will snugly and frictionally contact an adjacent vertical surface of one of the strips. Some of the pegs contact the surfaces of transverse strips and some contact the surfaces of longitudinal strips. Consequently, the pegs accurately locate the nest upon the pallet by manually positioning the nest over the area upon which it is to be located and then pushing the nest manually downwardly so as to frictionally engage the pegs with the adjacent strip surfaces. The downward movement results in the pegs guiding the nests into accurate, predetermined locations where they can then be locked in place by the fasteners 35. The number of pegs can be varied depending upon how many are needed for this purpose.

Figure 12:
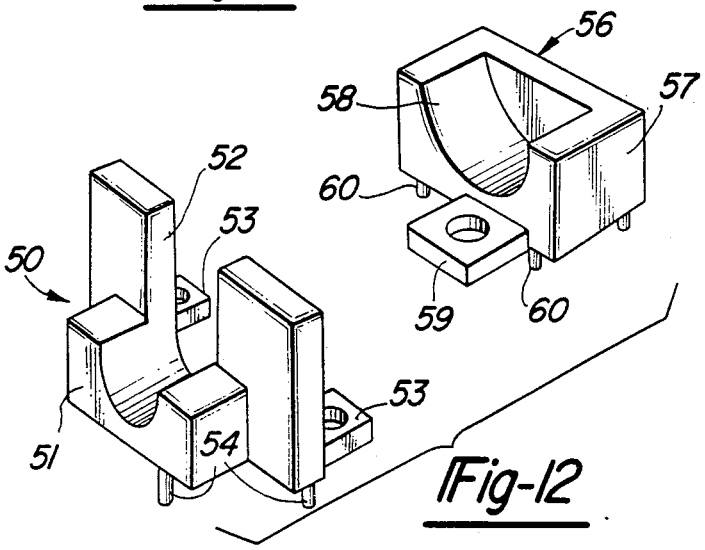
FIG. 12 is a perspective view of another form of nest or cradle, which is made in two cooperating parts.

As mentioned, the nests or cradles may be varied considerably in their shapes and sizes. Thus, by way of an example, FIG. 12 illustrates a modified, two section nest or cradle. Its forward section 50 comprises a base or body 51 having suitable cavity or parts receiving formation 52, and fastener lugs 53. In addition, downwardly extending projections or pegs 54 serve to locate the section upon the pallet base grid. Similarly, the rear section 56, is formed of a base or body 57, with a cavity or parts receiving formation 58 that corresponds to the shape of the portion of the part which is received by the body 57. A fastener lug 59 is provided for fastening and pegs 60 extend downwardly for locating the rear section upon the pallet base. Again, the shape and size of the sections are made to correspond to the particular parts that are to be carried by the conveyor. The sections are each injection molded out of a suitable plastic material.

The pallet base may be used separately for supporting objects directly upon its upper surface. However, it is especially designed for receiving and carrying different shaped nests or cradles so as to support one or more articles. The nests or cradles may be removed and interchanged for others when desired for handling different sizes or numbers of articles or they may be mounted upon the pallet and used for as long as the pallet system lasts.

The pallet system, as can be seen in the drawings, is essentially open and smooth surfaced so that it may be easily cleaned. This permits the removal of dirt, grease and any flammable coatings or attachments. Thus, by making the pallet and nests of a fire-resistant material, the entire unit may be more safely used within factory buildings without any substantial fire hazard.

Having fully described an operative embodiment of this invention, I now claim:

1. A pallet for supporting and conveying articles, comprising:

a normally horizontally arranged, integrally molded plastic grid formed of spaced apart elongated, longitudinal strips and transverse strips that intersect and are integral at their junctions to form regularly spaced apart, substantially identically size grid openings;

each of said strips being of a substantially uniform, generally rectangular cross-section whose vertical height is substantially greater than its horizontal width;

with the upper edges of the strips being substantially coplanar and defining an upper carrying surface, and with the lower edges of at least some of the longitudinal strips being coplanar to form parallel, elongated, skid-like suppots arranged to provide a flat, planar, lower pallet support surface;

said transverse strips being arranged at right angle to the longitudinal strips and being of a lesser height than the longitudinal strips which form the side-like supports so that the lower edges of the transverse strips are arranged a distance above the lower pallet support surface and are generally coplanar to form fastener engaging surfaces that are upwardly recessed relative to the lower pallet support surface;

a removable article holding member having an upper portion shaped to receive and hold an article, and a lower surface shaped to rest upon the pallet upper carrying surface in contact with the upper edges of a number of the longitudinal and transverse strips;

releasable fastening means mechanically securing the holding member to the pallet, with said fastening means including a portion arranged to engage upwardly against a transverse strip lower edge fastener engaging surface portion and being recessed above the lower pallet support surface, and said fastening means including a portion extending through its adjacent grid opening and connected to the holding member;

whereby articles may be placed upon the holding member for holding and conveying the articles upon the pallet, and the holding member may be selectively replaced with different holding member for holding different shaped articles.

2. A pallet as defined in claim 1, and said holding member having a number of spaced apart, downwardly extending projections formed on its lower surface, which projections are located to extend downwardly into their adjacent grid openings which are overlapped by the holding member for engaging against a portion of the vertical face of an adjacent strip portion and, thereby, accurately positioning the holding member upon the pallet.

3. A pallet as defined in claim 1, and said fastening means comprising a member having a head portion which extends across and engages upwardly against the lower fastener engaging surface of a pair of adjacent transverse strips, and a stem portion which extends upwardly through the grid, and a portion releasably engaged with the holding member for securing the holding member to the pallet.

4. A pallet as defined in claim 1, and said holding member being formed of an integral plastic molding having an upper article supporting surface that is shaped complimentary to the shape of a portion of an article to be conveyed for receiving and holding the article within said upper article support surface.

5. A pallet as defined in claim 1, and including integral, thin, narrow, horizontal, side cover bands extending between the upper edges of the outermost longitudinal strip and its next adjacent longitudinal strip on each longitudinal side of the pallet and which bands are located coplanar with the pallet upper carrying surface, with the bands formed integral with the portions of the upper edges of the transverse strips which they overlap between the longitudinal strips with which they are integral;

whereby the bands may cover conveyor parts which may underlie and support the lower edges of the longitudinal strips.

6. A pallet for supporting and conveying articles, comprising:

a grid formed of a unitary plastic molding made of intersecting longitudinal and transverse strips which are respectively parallel and spaced apart equidistantly;

said strips being of substantially uniform, generally rectangular cross-section and having a greater height than width;

and the upper edge surfaces of the strips defining an upper carrying surface, with the lower surfaces of at least some of the longitudinal strips being substantially coplanar to define a pallet lower support surface, and the remainder of the strips being of a lesser height so that their lower edges are recessed upwardly relative to said lower support surface to thereby form recessed fastening surfaces;

a unitary, plastic molded nest having an upper surface shaped to receive and support a corresponding article surface, and an opposite, lower surface rested against the upper carrying surface of the pallet, said nest having fastening portions overlapping at least some of the openings in the grid that are formed by adjacent intersecting strips;

a releasable fastener means for mechanically securing the nest portions to the pallet, including a part spanning between and overlapping adjacent strips which are recessed so that said part is recessed upwardly relative to the plane of the lower support surface, and with the fastener means including a portion extending from said recessed part through its adjacent grid opening between the overlapped adjacent strips towards the pallet carrying surface and is secured to said nest, whereby the nest may be selectively removed and replaced with a differently shaped nest for supporting different shaped articles.

7. A pallet defined in claim 6, and including an integral, narrow, flat, side cover sheet extending in the plane of the pallet upper carrying surface at the opposite sides of the pallet, with the sheets each being integral with their respective adjacent transverse and longitudinal strips;

whereby the cover sheets may cover conveyor parts which may be located beneath and which support the longitudinal strips along the sides of the pallet.

8. A pallet as defined in claim 7, and with the upper surfaces of the opposite corners of the pallet, including the areas of the cover sheets and said corners, being downwardly depressed relative to the upper support surface for providing locating areas at the corners of the pallet.

9. A pallet as defined in claim 6, and said nest having a number of spaced apart, downwardly extending projections that are formed on its lower surface and which are located so as to extend downwardly into their adjacent grid openings for engaging a portion of the vertical face of an adjacent strip portion and, thereby, accurately position the nest upon the pallet.

* * * * *

UNITED STATES PATENT AND TRADEMARK OFFICE

CERTIFICATE OF CORRECTION

PATENT NO. : 4,896,612

DATED : Jan. 30, 1990

INVENTOR(S) : James S. Salloum

It is certified that error appears in the above-identified patent and that said Letters Patent is hereby corrected as shown below:

On the title page, under "Related U.S. Application Data" 63 -- Application was not abandoned.
In the Abstract, 57 line 17, change "opening" to --openings--
In col. 2, line 5, change "palet" to --pallet--
In col. 2, line 14, after "or as multiple" add --article--
In claim 1, col. 5, line 53, change "suppots" to --supports--
In claim 1, col. 5, line 57, change "side-like" to --skid-like--

Signed and Sealed this

Sixth Day of August, 1991

*Attest:*

*Attesting Officer*

HARRY F. MANBECK, JR.

*Commissioner of Patents and Trademarks*